United States Patent [19]

Jouk

[11] Patent Number: 4,494,791

[45] Date of Patent: Jan. 22, 1985

[54] FOLDING WHEELCHAIR

[76] Inventor: Leo Jouk, 7, Avenue Ferrer, 93310 Le Pre Saint Gervais, France

[21] Appl. No.: 287,048

[22] Filed: Jul. 27, 1981

[30] Foreign Application Priority Data

Aug. 7, 1980 [FR] France ..... 80 17467
Jan. 16, 1981 [FR] France ..... 80 00709

[51] Int. Cl.[3] ..... A47C 4/28
[52] U.S. Cl. ..... 297/45; 297/DIG. 4
[58] Field of Search ..... 297/42, 45, 44

[56] References Cited

U.S. PATENT DOCUMENTS 2,927,631 3/1960 Andersson et al. ..... 297/42 X
3,968,991 9/1976 Maclaren ..... 297/42
4,076,304 2/1978 Deucher ..... 297/45
4,317,581 3/1982 Kassai ..... 297/45
4,362,315 12/1982 Kassai ..... 297/45
4,386,790 6/1983 Kassai ..... 297/45

*Primary Examiner*—Francis K. Zugel
*Attorney, Agent, or Firm*—Scully, Scott, Murphy & Presser

[57] ABSTRACT

A folding wheelchair which incorporates two side frames, a first cross-brace connecting the two side frames, which first brace is foldable, and two staffs rotatably mounted on respective each side frame. The wheelchair also possesses a second cross-brace connecting the two staffs, with the second cross-brace being constituted of two parts swivable about a common axis whereby the wheelchair is of lightweight and rigid construction.

16 Claims, 4 Drawing Figures

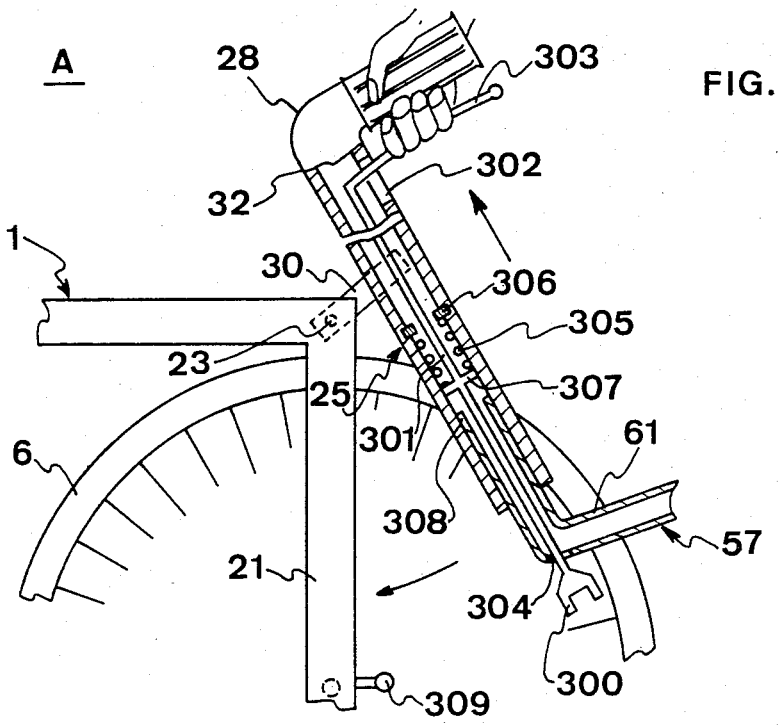
FIG. 3
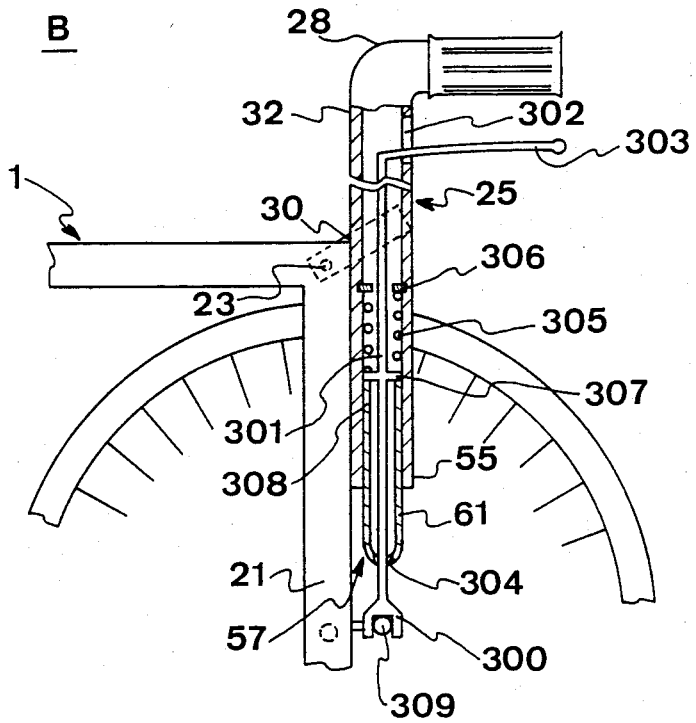

FOLDING WHEELCHAIR

The present invention relates to chairs and more particularly to wheelchairs which must allow easy folding and be of reduced volume when folded.

There are prior-art folding wheelchairs, very schematically, comprise in their essential elements two members forming a frame, two foldable arches connecting the two frames, these two arches and frames forming two parallelograms joined by one of their sides, these two parallelograms being deformable, thereby making it possible to approach the two frames together. The approaching of these two frames which, generally, support rolling means, can be controlled by a rotation of the staffs of the backrest which are fixed on these frames.

It is understandable that when the two frames have been brought together and the backrest staffs have been swivelled, the chair takes up minimum space.

However, it should be recognized that these chairs are intended more particularly for the physically handicapped who must, by themselves, be able to manipulate, fold, store and use them.

These chairs must consequently be foldable, advantageously into a minimum volume, for storage, particularly in vehicles, and must especially be as light as possible for current utilization particularly when they must be propelled by the handicapped themselves.

These conditions are often contradictory because folding requires a system of connecting rods, ball joints and levers in rather large number which contribute to loading these chairs considerably.

It is the object of the present invention to provide a folding wheelchair designed to be as light as possible with a minimum number of parts and providing good rigidity.

More particularly, it is the object of the invention to provide a wheelchair providing:

two side frames, a first cross-brace connecting said two frames, said first cross-brace being foldable, two staffs mounted rotatably respectively on each frame, characterized in that it comprises a second cross-brace connecting said two staffs, said second cross-brace comprising two rigid parts swivelling around a common axis.

Other characteristics and advantages of the present invention will appear through the following description given by way of illustration with reference to the appended drawings in which.

Figure 1:
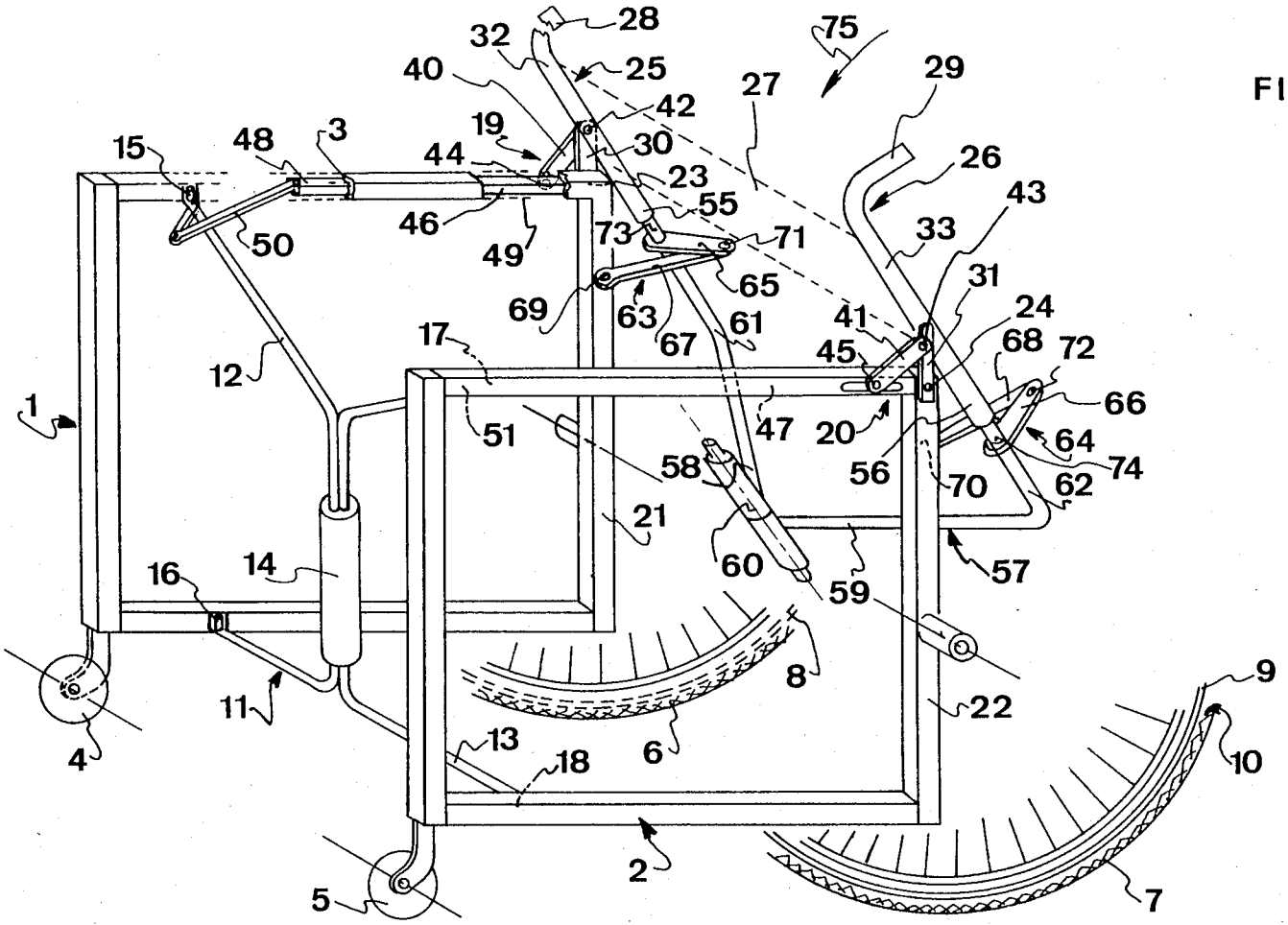
FIG. 1 represents a sectional perspective view of an embodiment of a folding wheelchair according to the invention.

FIGS. 3 A and B represent an embodiment of an improvement according to the present invention; and FIG. 4 represents an enlarged fragmentary detail of the joints of the folding wheelchair of FIG. 1, shown partly in section.

In FIG. 1 is illustrated an embodiment of a folding wheelchair.

It includes two frames 1 and 2 which are in two parallel planes. These frames are advantageously made up of rectangular members and preferably of hollow tubes having a square section, for example. One of these tubes appears, cut, at 3 on the frame 1. These two frames each support rolling means, for example a small idling wheel 4 and 5 and another larger diameter wheel 6 and 7, for the rolling of the wheelchair, notably by means of hand rings 8 and 9 fixed on the rims of these wheels 6 and 7.

Of course, for rolling comfort, these wheels have pneumatic tires with an inner tube, as shown clearly in the figure at 10 in the cutaway section.

In this embodiment, the two frames 1 and 2 are maintained in relation to each other by a first cross-brace 11 foldable in two parts 12 and 13 around an axis 14. These two parts designed in the form of an arch in materials such as rigid tubing are fixed rotatably at each end around axes 15 and 16 respectively on the frame 1 and axes 17 and 18 on the frame 2, not shown in the figure.

As stated earlier, the frames are made up of tubes forming rigid parallelograms which are generally in planes perpendicular to the rolling plane of the wheelchair. In this hypothesis, the axes 15 and 16 and the axes 17 and 18 are located on two lines which are also perpendicular to this rolling plane. Consequently, the two arches 12 and 13 are located respectively in two planes perpendicular to the rolling plane defined above and are capable of swivelling in relation to the plane of the frames around two lines going respectively through the pairs of axes 15, 16 and 17, 18 while constantly containing a common line, the one going through the axis of rotation 14 connecting the two arches 12 and 13.

The frames are made up of members and, at their tops 19 and 20 which are in the top position on the sides of the frame members 21 and 22, supporting respectively the larger diameter wheels 6 and 7, are mounted rotatably around respective axes 23 and 24, two staffs 25 and 26 which are capable of supporting a flexible canvas 27 constituting the backrest for the person using this wheelchair.

Usually, each staff comprises a curved part at its upper end forming handles 28 and 29 respectively for the staffs 25 and 26.

These two staffs also include two plates 30 and 31 respectively linked with the bars 32, 33.

These plates 30 and 31 are fixed on the side of these bars and on the sides of the frame members respectively around the axes of rotation 23 and 24 as indicated earlier, Consequently, the two bars 32 and 33 forming a rigid assembly are located respectively in the plane of the frames 1 and 2 so as to reduce, as will be explained below, as much as possible the space requirements of the wheelchair particularly when it is folded.

The wheelchair also comprises connection means between each staff 25 and 26 with each part 12 and 13 of the cross-brace 11, so that when these staffs swivel respectively around the axes 23 and 24, they impart another rotation to the two parts 12 and 13 respectively around the pairs of axes 15, 16 and 17, 18.

These means comprise, for each staff and part, a first lever 40 and 41 connected at one end to the staff at different points 42 and 43 respectively of the rotation axes 23 and 24. The other end of these levers is mounted to swivel at 44, 45 on the end of a slide rod 46 and 47 (the slide rod 47 not being shown in FIG. 1).

These slide rods 46 and 47 are guided by bearings shown schematically at 48 and 49, permiting essentially only one degree of freedom in sliding.

Advantageously, the slide rod is located inside tubes 3 of square section forming the members of the frames and which allow the slide rods, which also have a corresponding square section, to slide within these tubes 3 which form housings for said slide rods.

The other ends of the slide rods 46 and 47 opposite to that connected to the lever 40 and 41 each support a connecting rod 50 and 51 whose two ends are mounted rotatably on pins, on the one hand, on the slide rods 46 and 47 and, on the other, on the two parts 12 and 13 of the cross-brace 11. These connecting rods make it possible to transform the sliding movement of the slide rods into a rotating movement for the parts 12 and 13. Of course, the levers 40 and 41 and the connecting rods 50 and 51 cooperate with their respective slide rod through openings 81, 82 (FIG. 2) provided in the wall of the tubes 3.

A description was already given of a first cross-brace 11 connecting the two main frames 1 and 2. However, it is clearly understood that a single cross-brace is not sufficient for the proper stability of a wheelchair, particularly one used by the physically handicapped.

Accordingly, the two staffs support at their ends 55 and 56 opposite those of the handles 28 and 29 a second cross-brace 57 foldable into at least two rigid parts 58 and 59 around a rotation axis 60. These two parts are made, for example, of steel or aluminium tubes.

The rotation axis 60 is advantageously parallel to the two bars of the staffs. This assembly thus forms two planes articulated around this axis 60, thereby requiring the two bars to remain constantly parallel even when only one of them is manoeuvered when the wheelchair is being folded.

The two parts 58 and 59 are in the form of an L and are supported respectively in the staffs 25 and 26 so that they can swivel around the axis of the bars 32 and 33 and advantageously within them in order to obtain rigidity on rotation around an axis perpendicular to these bars.

As illustrated, the bases 61 and 62 of the parts 58, 59 extend respectively the two bars 32 and 33.

Each base 61 and 62 is connected to the frames by means of connection means constituting a linkage system 63 and 64.

This linkage 63 and 64 includes a projecting lug 65, 66 fixed solidly at 73, 74 on the base 61, 62, and a link 67, 68, one end of which is mounted to swivel on a fixed point of the frames by means of a first ball point 69, 70, the other end of which is mounted to swivel on the end of the lug 65, 66 by means of a second ball joint 71, 72; as shown in detail in FIG. 4 of the drawings. These connection means thus make it possible, when the staffs swivel respectively around the axes 23 and 24, particularly in the direction of the arrow 75, to move the ends 55 and 56 away from the frames and hence from the points 73, 74.

The ball joints 69, 70 and 71, 72 thus make it possible to absorb the torsions of the links in relation to the elements to which they are connected. When these staffs 25 and 26 swivel around the axes 23 and 24, the connecting rods 64 and 65 move away from the frames but the fixed length of the connecting rods 67 and 68 requires the connecting rods 65 and 66 to rotate since the distance of the axes 69, 71 and 70, 72 is fixed.

This movement of the points 73, 74 exerts a force on the ball joints 71 and 72 through the links 67, 68 which thus leads to the swivelling of the two bases 61 and 62 in relation to the bars 32, 33. In the case of the figure, the rotation of the two bases 61, 62 drives by the same rotation the assembly of the two parts 58, 59 and the second cross-brace 57. This rotation takes place in two opposite directions around the axis 60 and has the consequence of bringing toward each other the two staffs 25, 26 and hence the two frames 1 and 2.

As stated above, the swivelling of the two staffs as described eariler also leads to the rotation of the two arches around the axis 14 so that the two frames are brought closer together.

The swivelling of the staffs in the direction opposite that indicated by the arrow 75 brings about opposite movements to those described above. Consequently, these two frames 1 and 2 move away from each other.

Of course, the wheelchair will require a flexible canvas which will be suspended between the two frames 1 and 2 on the two top members, this canvas forming a seat and allowing easy folding of the wheelchair.

This wheelchair can also include armrests and footrests. These means are known in themselves and shall not be further described. The wheelchair illustrated in FIG. 1 is folded and unfolded in the following manner.

The explanation of its folding or unfolding will be presented below with reference to FIG. 2 which represents a side view of the wheelchair according to FIG. 1, in which appears the illustration of the movement of the different components of the wheelchair.

It has already been stated that the folding of the wheelchair takes place by pressing on either of the two staffs 25 or 26.

When the wheelchair is unfolded, the staffs 25 and 26 and the cross-brace 11 occupy the positions P1. When the wheelchair is to be folded, a force is applied, manually, for example, in the direction of the arrow 75 on one of the staffs. This causes them to rotate and to occupy simultaneously the intermediate position P2.

When the staffs swivel simuntaneously, the first cross-brace "breaks" by the rotation of the two arches around the axes 15, 17 and 16, 18 and their common axis 14, and the second cross-brace 57 also breaks by rotating around the bases 61, 62 and the common point 60.

Figure 2:
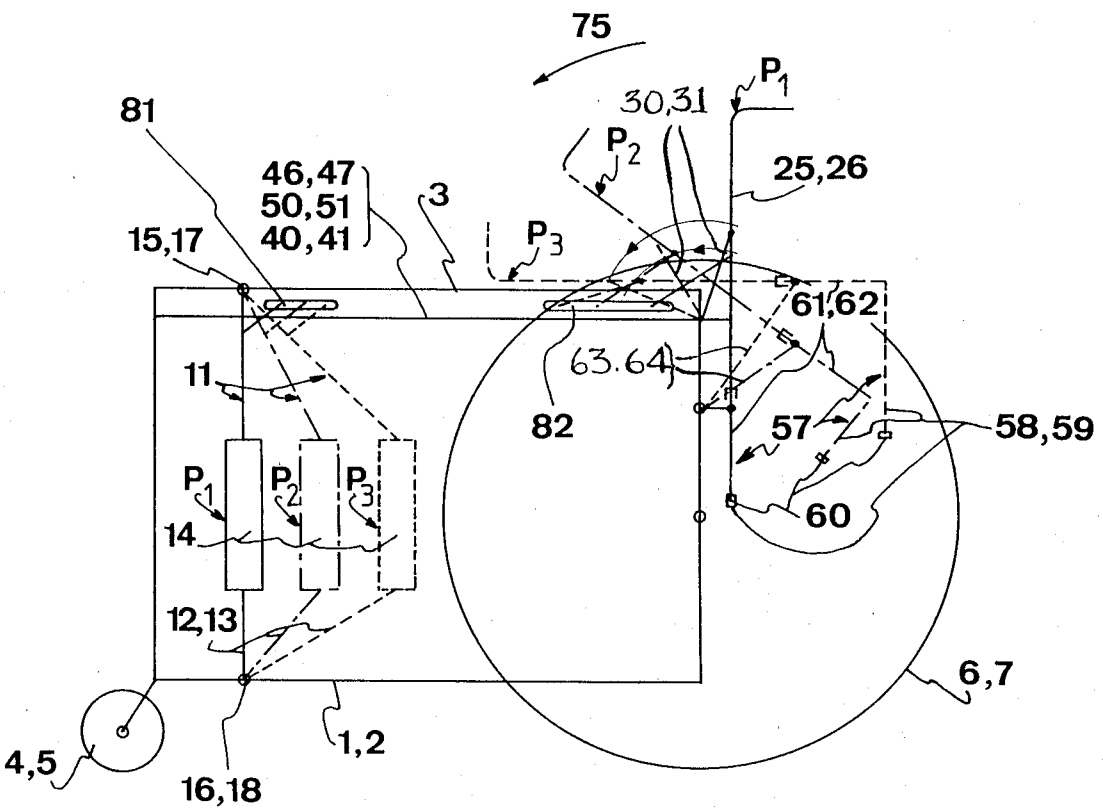
FIG. 2 represents a schematic diagram illustrating the manner in which is accomplished the folding of the wheelchair of FIG. 1.

Referring to FIG. 2, it is noted that in the initial position the arches 12 and 13 of the first cross-brace are in the position P1 substantially in a plane perpendicular to that of the frame members and hence to that of the figure in this embodiment.

On the other hand, owing the rotations and, notably in the intermediate position P2, the partial rotations of the parts of the cross-brace begin to appear owing the fact that they are located in planes forming a non-zero angle with those of the frame members and the plane perpendicular to them, and hence their projection on the plane of the figure causes them to appear but not in their real size (in reference to the scale). At the end of their swivelling, the staffs take on an almost horizontal position, represented by P3.

In this position, the frames have completed a 90-degree rotation, simultaneously allowing the four parts 12, 13 and 58, 59 of the two cross-braces 11 and 57 to complete an equivalent rotation of 90 degrees which has consequently brought them up against the frames 1 and 2, and against each other to the first cross-brace and for the second cross-brace 57.

In fact, the positions P3 in the figure represent the folded cross-brace, which are in planes parallel to those of the frames and hence this representation method according to the figure is such that these parts of the cross-brace appear in projection in their real scale in relation to other elements of the wheelchair.

To unfold the wheelchair, it is necessary to exert a force on one of the staffs in the direction opposite that of the arrow 75, which then pivots from the position P3 to the position P1, passing again through the intermediate position P2. This swivelling takes place until the bars 32, 33 come up against the edge of the frame members and the corresponding stops provided on these members, which define the position of the completely folded wheelchair.

The wheelchair can advantageously include means for blocking it in the unfolded position. These means can, for example, consist of hooks attached to the frames capable of engaging with dogs attached, for example, on the ends 55 and 56 of the staffs 25, 26.

The wheelchair as described offers many advantages, particularly as concerns space requirements. For example, it does not have a cross-brace parallel to the first at the level of the large wheels 6 and 7, so that the two frames 1 and 2 can be placed perfectly against each other. This is advantageous because this is where the large diameter wheels, which take up considerable space, are located. This absence of a cross-brace at this level thus contributes to reducing the width space taken up.

A second advantage results therefrom. Since this wheelchair does not have this second cross-brace, its weight is reduced almost by the same amount, except in fact for that of the cross-brace 57, which can be almost negligible.

Another advantage is found notably in the fact that, since the connections and articulations of the cross-braces are all connected directly or indirectly with the two staffs, it is possible to fold or unfold the wheelchair with one hand and on either side, by means of either of the staffs.

In the example described with reference to FIG. 1, the connection means between the second cross-brace 57 and the two frames 1 and 2 are made up essentially of sets of connected rods 63, 64 mounted on ball joints.

FIGS. 3 A and B show the elements of the wheelchair necessary for the understanding of the present invention.

It is first of all pointed out that in the present description, the references used and which are found in the preceding figures designate the same elements and that, moreover, the same references in FIGS. A and B designate the same elements also.

In FIG. 1 is represented the structure of the wheelchair comprising two frames, such as the frame 1 made up of frame members, in a corner of which is articulated for rotation around an axis 23 a staff 25 consisting of a bar 32 terminated by a curved part forming a handle 28. This hollow tubular bar 32 supports a base 61 of the cross-brace 57, this base being capable of turning about itself in this bar 32.

In addition, it is quite evident, when the wheelchair is unfolded, in order to move with or without a passenger, it is normal for this wheelchair, since it is being pushed by means of the handles, should not have a tendency to fold. To ensure this, it has means for blocking it in its unfolded position.

FIGS. 3 A and B represent an advantageous embodiment of these blocking means.

These means include a pawl 300 attached to a rod 301 capable of sliding in bearing means which are advantageously made up of the very interior of the bar 32 of the staff 25.

One end of this rod 301 goes through the bar 32 through an opening 302, the emerging part 303 of this rod being advantageously curved, relatively near the handle 28, to form a gripping means for the purpose to be explained below. The other end goes through the end 55 of the bar 32 and through the bar 61 through a guide hole 304.

Furthermore, this rod 301 is subjected to the action of a thrust force provided by a spring 305 cooperating with a pin 306 integral with the bar 32 and a shoulder 307 integral with the rod 301, this shoulder coming up against the end 308 of the base 61 when the spring is at maximum expansion, and this in order to prevent the rod from coming out of its housing. In addition, this shoulder can be designed so that its side wall slides against the inner wall of the bar 32 and thus forms one of the elements of the bearing means guiding the rod in its movements.

The wheelchair also includes a hook 309 integral with the side 21 of the frame 1 against which bears the staff 25 when the wheelchair. is unfolded. In the illustrated embodiment, this hook is made up of a solid piece mating with the pawl 300 which, in this case, has the form of a stirrup.

The operation of the wheelchair according to FIGS. 3 A and B is the following.

Let us consider that the wheelchair is being unfolded as shown in FIG. 3 A.

The person unfolding the chair pulls on the gripping means 303 in opposition to the spring 305 and, in this position of the rod, moves the staff 25 up against the side 21 of the frame 1. Once in this position, the stirrup is located just opposite the hook 309 and the person can release the gripping means 303, so that the stirrup comes around the hook 309.

This cooperation blocks the staff and it is consequently no longer able to rotate for the folding of the wheelchair.

Having done this, the wheelchair can be pushed by means of the handle 28 for travelling. It is moreover pointed out that, owing to the structure of the wheelchair, it is not necessary to provide a second blocking for the other staff because if one of the two staffs is kept blocked, the other one will also be blocked.

Finally, the embodiment of the pawl and of the hook can be taken in the broadest sense, i.e. of two parts of any kind which, when they cooperate with each other, prevent the relative movement of one part in relation to the other. Hence, in the illustrated embodiment, the pawl has a female function while the hook has a male function and, of course these two functions can be easily reversed and even combined.

I claim:

1. In a chair including two lateral frames; a first cross-brace connecting said two frames, said first cross-brace being foldable, two staffs mounted rotatably respectively on each said frame, the improvement comprising a second cross-brace connecting said two staffs, said second cross-brace having two rigid parts swivable about a common axis; said first cross-brace being foldable into two rigid parts, each of said two rigid parts being mounted to swivel respectively on said two frames and being swivable about the same axis; second connection means between each part of the first cross-brace and each staff, both of which are rotatably connected to the same frame, said second connection means comprising, for each part and staff, a slidably mounted slide rod, the two ends of which are connected through rotation axes by a lever fixed to said staff and by a connecting rod mounted rotatably on said respective parts.

2. Chair according to claim 1, wherein said two parts of the second cross-brace each have a base rotatably mounted on each staff for rotation about an axis.

3. Chair according to claim 2, wherein said bases are rotatably mounted in said staffs, said staffs consisting of hollow bars.

4. Chair according to claim 1, comprising first connection means between each part of said second cross-brace, each said frame supporting the staff on which said part is rotatably mounted.

5. Chair according to claim 4, wherein said first connection means includes a projecting lug on each of said parts and two links mounted to swivel on a ball joint on respectively said two frames and an said projecting lugs.

6. Chair according to claim 5, wherein said links are mounted to swivel on the respective frames which provide rotational support for said two staffs on which there respectively swivel said parts.

7. Chair according to claim 1, wherein said slide rods are respectively arranged in recesses in said frames, the levers and connecting rods extending through opening formed in said frames.

8. Chair according to claim 1, wherein said staffs extend in parallel, the common axis between said two rigid parts of the second cross-brace extending in parallel with said two staffs.

9. Chair according to claim 1, comprising controllable means for blocking at least one of the two staffs in a predetermined position.

10. Chair according to claim 9, wherein said controllable means includes a pawl integral with a support cooperating with said staff, and a hook integral with said frame on which said staff is rotatably mounted, said hook being arranged on said frame for engaging said pawl in a predetermined position of said staff.

11. Chair according to claim 10, wherein said support comprises a rod and bearing means attached to said staff in which said rod is slidable.

12. Chair according to claim 10, comprising means for applying a force to said support, and means for defining a limit to the sliding position of said support.

13. Chair according to claim 11, wherein said staff comprises a hollow tube, and said bearing means is located within said hollow tube, a portion of said rod being slidable in said tube, a first end of said rod extending from said tube and supporting said pawl, the other end of said rod extending from said tube comprising gripping means.

14. Chair according to claim 10, wherein said pawl comprises a stirrup, and said hook having a part with said stirrup extending thereabout to prevent the rotation of the staff having said rod arranged therein.

15. Chair according to claim 11, wherein said rod is slidable within the rigid part swivable in said tube forming said staff, said rod extending through a hole formed in said rigid part.

16. Chair according to claim 15, wherein said hole forms one of the bearing means for said rod.

* * * * *